United States Patent [19]

Gillum

[11] Patent Number: 4,579,037

[45] Date of Patent: Apr. 1, 1986

[54] MACHINE PISTOL WITH RETARDED BLOWBACK

[75] Inventor: Richard R. Gillum, Marblehead, Ohio

[73] Assignee: Weapon Technology Systems R & D, Ltd., Westlake, Ohio

[21] Appl. No.: 579,265

[22] Filed: Feb. 13, 1984

[51] Int. Cl.[4] ..... F41C 21/18; F41C 23/00

[52] U.S. Cl. ..... 89/180; 42/72; 89/14.3; 89/196

[58] Field of Search ..... 89/180, 196, 195, 194, 89/14.3, 14.4; 42/72, 71 P

[56] References Cited

U.S. PATENT DOCUMENTS

| | | | |
|---|---|---|---|
| 785,974 | 3/1905 | McClean | 89/14.3 X |
| 785,975 | 3/1905 | McClean | 89/14.4 X |
| 1,738,751 | 12/1929 | Bluehdorn | 89/163 |
| 2,935,000 | 5/1960 | Mowrey | 89/14.3 |
| 3,261,264 | 7/1966 | Wilson | 89/180 X |
| 3,990,346 | 11/1976 | Irwin | 89/180 |
| 4,207,799 | 6/1980 | Tocco | 89/196 |
| 4,321,765 | 3/1982 | Gillum | 42/72 |

*Primary Examiner*—David H. Brown

*Attorney, Agent, or Firm*—Pearne, Gordon, Sessions, McCoy, Granger & Tilberry

[57] ABSTRACT

A machine pistol with means for retarding blowback of the slide assembly. The device has both right hand and left hand stocks to enable the weapon to be fired from a comfortable visual sighting position at eye level with the wrist axes perpendicular to one another. The slide assembly includes a bolt that carries the firing pin, extractor and ejector and that reciprocates relative to the receiver and barrel, and a tubular cylindrical muzzle sleeve removably connected to the forward end of the bolt and that fits coaxially around the barrel. A coaxial helical spring fits between the barrel and muzzle sleeve to urge the muzzle sleeve (and bolt) to the forward firing position wherein the forward end of the muzzle sleeve extends outwardly beyond the end of the barrel. A plurality of an annular internal grooves are formed in the forward end of the muzzle sleeve so that the momentum of the escaping gases immediately following firing exerts a force against the sidewalls of the grooves to retard blowback of the slide assembly.

12 Claims, 7 Drawing Figures

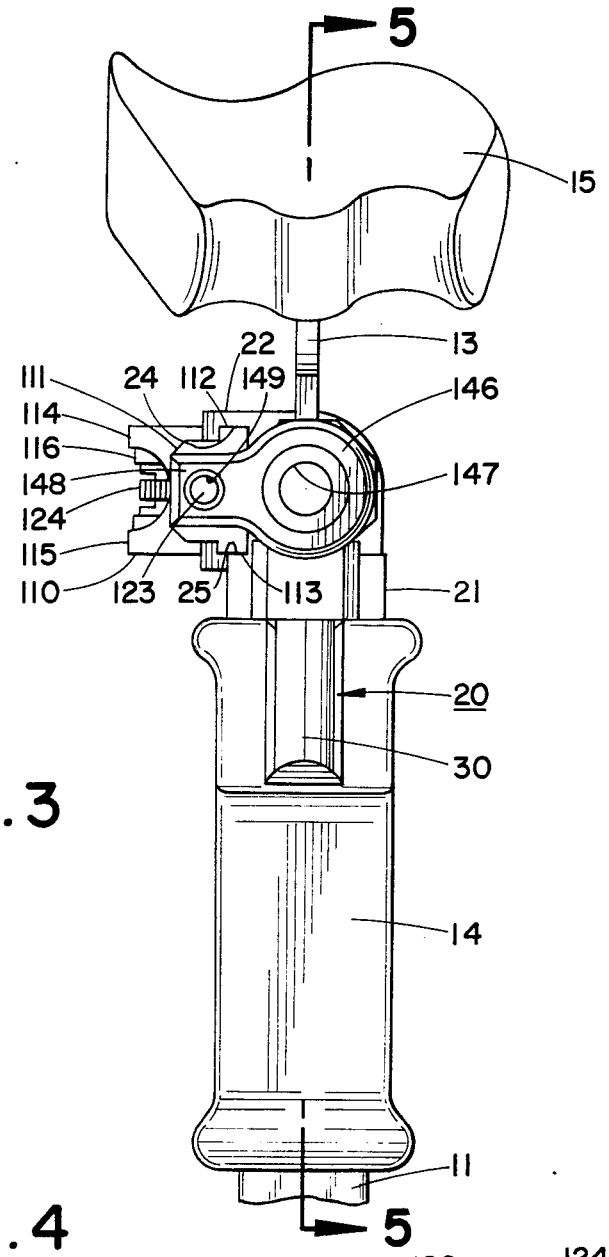
FIG. 3
FIG. 4
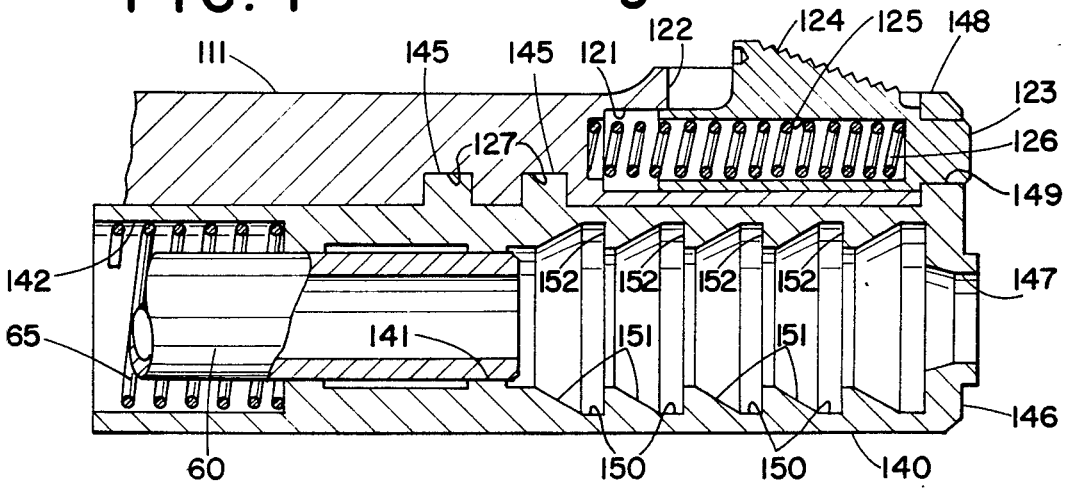

MACHINE PISTOL WITH RETARDED BLOWBACK

BACKGROUND OF THE INVENTION

This invention relates to hand held automatic firearms—namely firearms that automatically extract a spent cartridge from a firing chamber after a shot is fired, retract the bolt, eject the cartridge and present a fresh cartridge to the chamber for a subsequent shot whereby continued depression of the trigger is effective to fire repeated shots until the trigger is released. More particularly the invention relates to machine pistols working on the blowback principle with open bolt operation, and especially to a light weight weapon with means to retard blowback of the bolt mechanism in order to reduce the cyclic firing rate and improve controllability.

Machine (fully automatic) pistols are generally available and useful only for limited purposes such as military applications to include counter-insurgency and anti-terrorist type missions and police special weapons team operations. While these light weight automatic weapons are highly respected for their capabilities, they do have certain limitations and require considerable strength and skill on the part of the operator.

A recent improvement in the design of hand held automatic firearms to improve the ease of handling and accuracy is shown in my U.S. Pat. No. 4,321,765, the disclosure of which is incorporated by reference herein and made a part hereof. The holding apparatus shown therein is incorporated in the design of the machine pistol of the present invention.

Briefly, that holding apparatus includes separate right hand and left hand stocks, the right hand stock being a generally conventional pistol grip wherein the trigger finger is placed through the trigger guard in position to squeeze the trigger. The weapon is held in a generally horizontal position with the right hand stock extending laterally to the right so that the palm of the operator's right hand is horizontal. The left hand stock extends from the opposite side of the weapon and includes a left hand grip so formed that the palm of the operator's left hand is generally vertical. Accordingly, the operator's comparable wrist axes are perpendicular to one another, thus providing an improved capability for controlling the weapon.

One problem with machine pistols in the past has been the inherent high cyclic firing rate that results when an attempt is made to reduce weight and improve ease of handling.

In heavier blow-kick-type, automatic firearms such as sub-machines guns that may be fired from the waist or while supported by a sling, the mass of the bolt assembly is sufficient to provide the inertia needed to maintain a desired firing rate and thus achieve satisfactory controllability and accuracy. In the lighter type of automatic weapon, however, the inertia of the bolt assembly is relatively small. Accordingly higher cyclic firing rates result and in turn a reduced controllability.

The result is that the weapon is less accurate, the ammunition is used less effectively in that too many rounds are fired for each depression of the trigger and the operator must use excess time and effort in unloading and reloading ammunition clips.

The machine pistol of the present invention however provides a novel retarded blowback arrangement (and thus a reduced cyclic firing rate) in a design incorporating light-weight components (including the bolt assembly) and affords other features and advantages heretofore not obtainable.

SUMMARY OF THE INVENTION

It is among the objects of the present invention to control (reduce) the cyclic firing rate of a blowback-operated machine pistol of relatively light-weight construction.

Another object is to improve the controllability and accuracy of a blowback operated machine pistol.

A further object is to improve the controllability of a hand held machine pistol designed to be supported at eye level in a standing, visual sighting position.

These and other objects and advantages are achieved with the novel machine pistol design of the present invention. The weapon includes a receiver or frame to which right hand and left hand stocks are mounted, a barrel connected to the receiver and defining a firing chamber and means extending through the right hand stock for holding ammunition clips that feed ammunition rounds seriatim to the breech.

In accordance with the invention a slide assembly extending axially for the full length of the pistol and including a bolt with a firing pin carried thereby, is mounted for reciprocating travel relative to the receiver and barrel and is urged to a forward firing position by a helical bolt spring coaxially mounted around the barrel.

The slide assembly includes a bolt block at the rear that carries the firing pin, extractor and ejector, and in front, a tubular muzzle sleeve operatively connected to the slide assembly and located on the barrel for axial movement thereon between a rearward position and a forward position projecting forwardly from the front end of the barrel. The forwardly extending end of the tubular muzzle sleeve has a plurality of internal annular grooves formed therein with rearwardly facing annular side walls that lie in respective radial planes. After the machine pistol is fired, the momentum of the gas escaping from the forward end of the barrel exerts a force against the rearwardly facing annular side walls of the grooves to retard rearward movement of the slide assembly and thus reduce the cyclic firing rate and prevents premature opening of the breech.

Another feature of the invention is the simplicity of construction which minimizes the number of parts required. These parts are so arranged that field stripping can be done very quickly without the use of any tools. Furthermore the moving parts present an open arrangement without enclosed cavities which can collect water, sand or dirt to cause possible jams.

BRIEF DESCRIPTION OF THE DRAWINGS

FIG. 3 is a front end elevation of the machine pistol of FIGS. 1 and 2;

FIG. 4 is a fragmentary sectional view on an enlarged scale taken on the line 4—4 of FIG. 3 showing the slide assembly muzzle sleeve in its forward firing position;

DESCRIPTION OF THE PREFERRED EMBODIMENT

Figure 1:
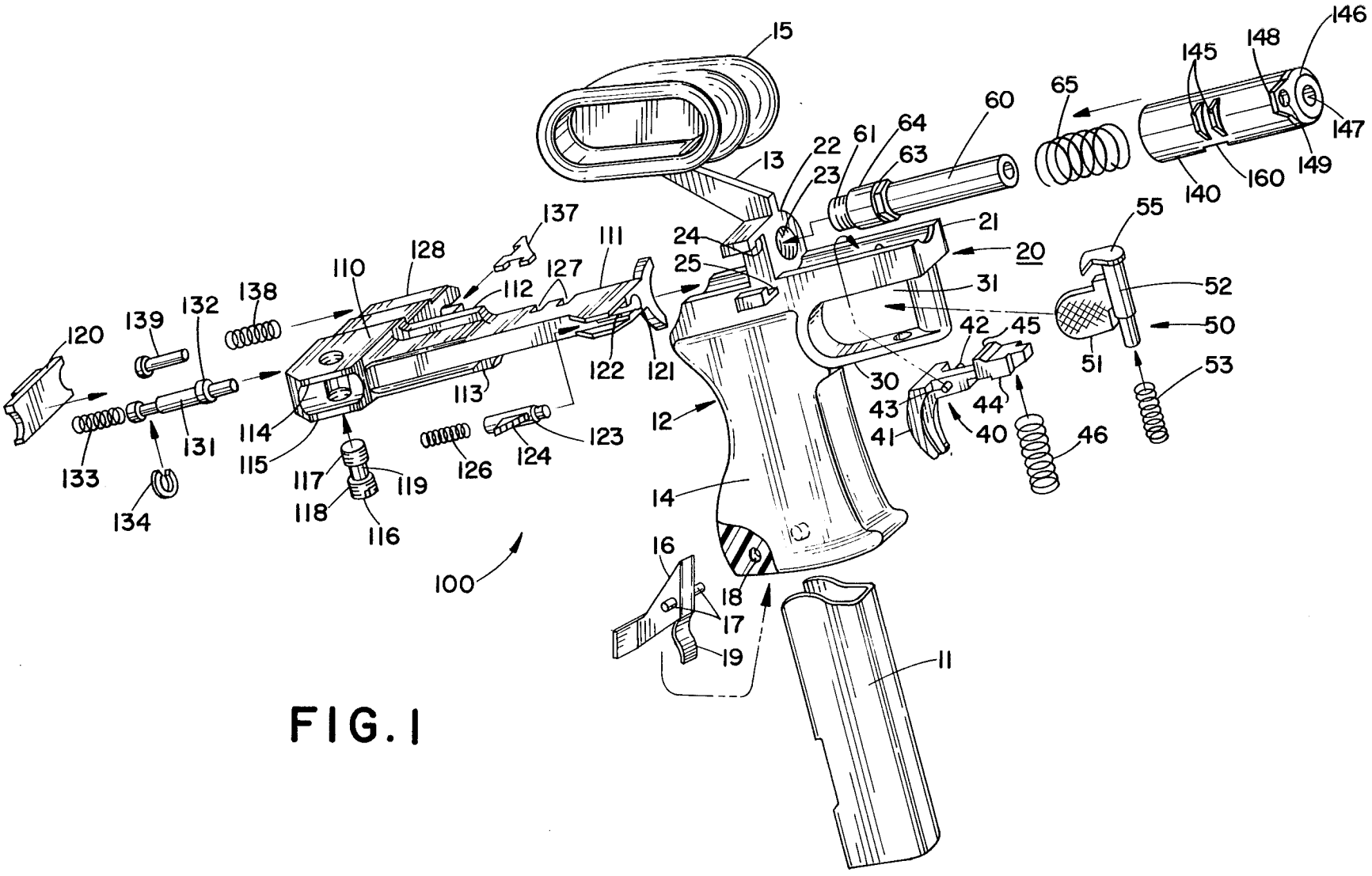
FIG. 1 is an exploded perspective view of the machine pistol of the invention showing the device disassembled and broken down into its component parts but with components placed in an assembly alignment and with arrows indicating the general manner of assembly.

Referring more particularly to the drawings, there is shown a blowback operated machine pistol 10 embodying the invention and adapted to receive an ammunition clip 11 for feeding appropriate size rounds 11*a* seriatim to the weapon.

General Arrangement

The pistol 10 includes as its principal components, a receiver assembly 20 including a trigger assembly 40 and safety assembly 50, a barrel 60 and a slide assembly 100. The weapon is adapted to be held at an eye level, visual sighting position by means of a right hand stock 12 of generally conventional design and a left hand stock 13 both of which form an integral part of the receiver assembly 20. The arrangement of the stocks 12 and 13 and thus respective grips 14 and 15 as indicated above embodies the design of my U.S. Pat. No. 4,321,765.

The right hand stock 12 is fixed to the receiver at one side of the barrel axis such that the trigger finger may be used to operate the trigger in a conventional manner. The left hand stock 13 is fixed to the receiver on the opposite side of the barrel axis in alignment with the right hand stock 12. However the left hand stock 13 has a grip 15 that is adapted to be held in such a way that the operator's left hand wrist axis is perpendicular to the operator's right hand wrist axis. This divides firing recoil between the user's hands in a generally symmetrical manner to provide improved control. The right hand grip 14 defines a channel 16 for receiving the ammunition clip 11. The grips 14 and 15 are formed of a molded plastic material.

The design of the weapon is calculated to minimize the number of working parts and to simplify assembly and disassembly. FIG. 1 depicts the weapon in a disassembled condition and it will be noted that there are only 20 parts to the entire assembly. The parts interfit and cooperate with one another in such a way that complete disassembly can be accomplished in a few seconds. Likewise reassembly takes only a few seconds.

Receiver Assembly and Barrel

The receiver assembly, generally identified by the numeral 20, includes a main body portion 21 made from steel stock and having a rectangular opening that communicates with the channel in the stock 12. An outwardly extending post 22 with a threaded bore 23 serves as a mount for the barrel 60. The post 22 also serves as a mount for the left hand stock 13 and defines a pair of keyways 24 and 25 for the slide assembly 100 to be described in more detail below.

The receiver assembly 20 also includes a trigger guard 30 that defines an opening 31 for the trigger finger of the operator and the trigger itself. Located above the opening 31 is a channel 32 (FIG. 5) adapted to receive the trigger assembly 40 and the safety assembly 50.

The trigger assembly 40 is pivotally mounted in the receiver 20 and includes a trigger 41, a pair of oppositely extending coaxial pivot pins 42 and 43 and a lever arm 44 having the major portion thereof positioned in the channel 32. The trigger 41 extends into the opening 31 for engagement by the finger of the operator and the lever arm 44 extending in the opposite direction from the pivot pins 42 and 43 includes a sear 45 adapted to engage a sear notch 160 in the muzzle sleeve to retain the slide assembly 100 in the cocked position in a manner to be described in more detail below.

Figure 5:
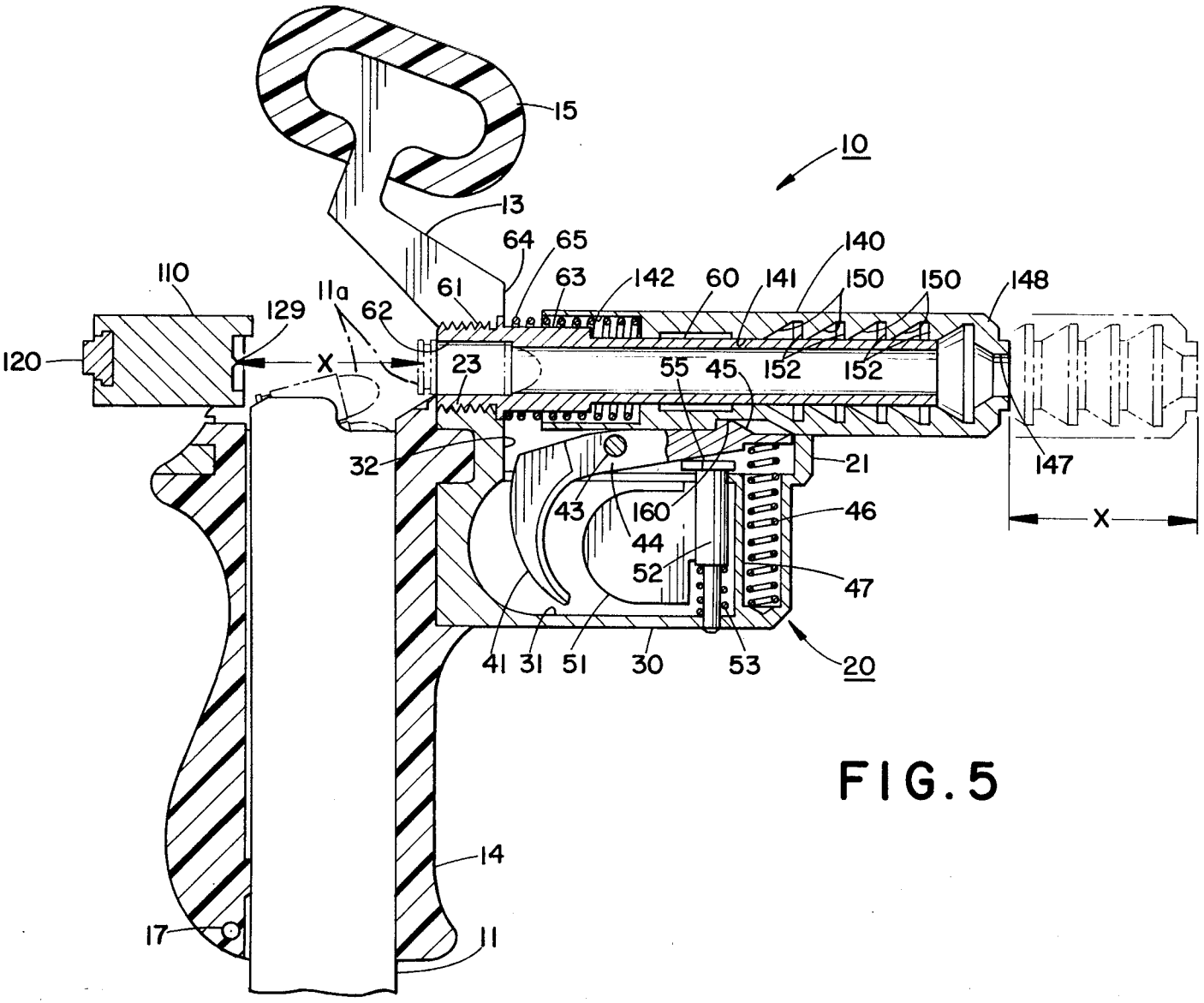
FIG. 5 is a sectional view on an enlarged scale taken on the line 5—5 of FIG. 3 showing the slide assembly muzzle sleeve in its retracted (cocked) position in solid lines and in its forward firing position in dashed lines.

The trigger 41 is urged to the cocked position illustrated in FIG. 5 by means of a helical spring 46 received in a bore 47 formed in the forward end of the trigger guard 30. The upper end of the spring 46 bears against the bottom of the extending lever arm 44 of the trigger 41. When the trigger is pulled the spring 46 is likewise depressed as the lever arm pivots about the axis of the pins 42 and 43 to release the slide assembly.

The safety assembly 50 cooperates with the trigger assembly 40 to lock the trigger in its cocked position. The assembly 50 includes a safety plate 51 connected to a pivot pin 52 journaled at both ends in the trigger guard 30 and extending vertically through the trigger guard as shown in FIG. 5. A helical spring 53 urges the pin 52 in an upward direction.

Figure 2:
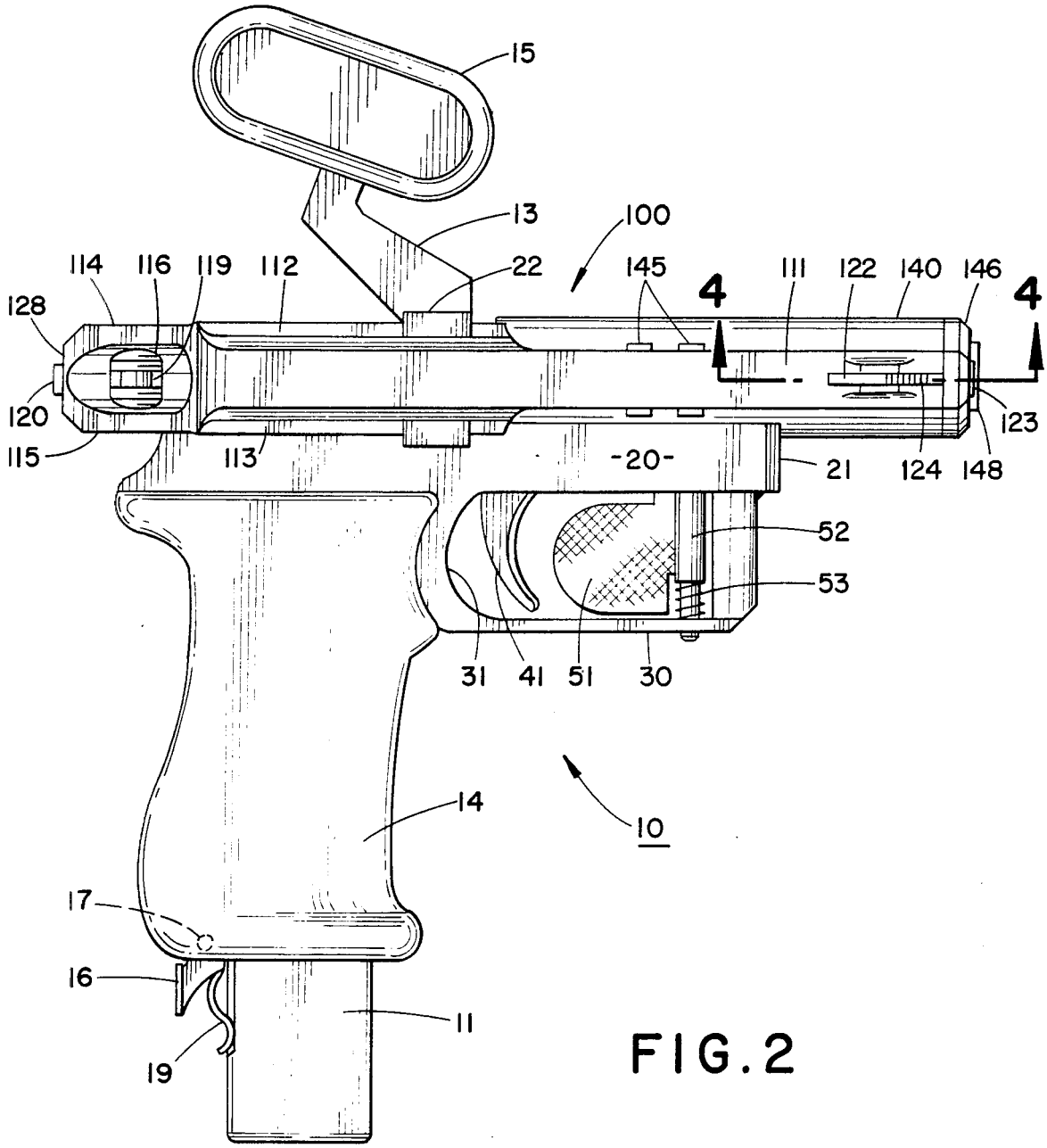
FIG. 2 is a plan view of the machine pistol of the invention (when held in the firing position) showing an ammunition clip loaded therein and the slide assembly in the cocked position.

Accordingly the safety plate 51 pivots between a released position (not shown) and a locking position located entirely within the trigger guard 30 (FIGS. 2 and 5) wherein it functions in two ways. It prevents accidental actuation of the trigger 41 by blocking the space in the trigger guard and also a locking head 55 located at the top of the pivot pin 52 engages the bottom of the lever arm 44 to lock it in the cocked position. When the safety plate 51 is pivoted to a position between 45° and 90° to its released position the locking head 55 swings away from alignment with the lever arm 44 and permits the pin 52 to move downward and depress the spring 53. Accordingly the safety is automatically removed when the operator's finger is placed on the trigger 41 and is automatically applied when the weapon is holstered or laid on its side.

The barrel 60 is made of high grade steel and has a threaded end 61 with external threads that are threaded into the opening 22 in the receiver block 21. The threaded end 61 also defines a firing chamber 62. The threads are cut in a rearward portion 63 of enlarged diameter that defines a shoulder 64. A helical recoil spring 65 coaxially mounted on the barrel 60 bears between the shoulder 64 and the muzzle sleeve (FIG. 5) and urges the slide assembly forward to the firing position.

Slide Assembly

The slide assembly 100 includes as its two interconnected basic components a bolt 110 and muzzle sleeve 140. The bolt 110 has a generally L-shaped configuration including a forwardly extending leg 111 that extends along and adjacent the barrel 60 along the side of the receiver 20 or more correctly along the top of the receiver 20 and barrel 60 with reference to the firing position of the weapon whereby the right and left hand stocks extend laterally (horizontally) rather than vertically.

The forwardly extending leg 111 has a pair of oppositely extending longitudinal keys 112 and 113 that are slidably received in the keyways 24 and 25 formed in the main body 21 of the receiver. The cooperation between the keys 112 and 113 and keyways 24 and 25 helps to guide the reciprocating sliding movement of the bolt assembly 100 relative to the receiver.

The top of the bolt 110 has a pair of sight brackets 114 and 115 with coaxial threaded bores formed therein that are adapted to receive a rear sight 116. The rear sight 116 is a spool shaped element with enlarged threaded ends 117 and 118 and a central shaft 19 which, when the sight is threaded into the brackets 112 and 113, may be centered between the brackets or, by rotating the sight, be positioned to the right or left of center for sight adjustment purposes.

The forward end of the leg 111 has an axially extending bore 121 formed therein (FIGS. 4 and 6) and defines a slot 122 that communicates with the bore. The bore 121 receives a locking pin 123 with an integral front sight 124 that extends upwardly through the slot 122 and which may be used in cooperation with the rear sight 116 for aiming the weapon. The pin 123 has a central bore 125 and a helical spring 126 is positioned therein to urge the pin to a forward position for purposes of assembly as will be described in more detail below.

The main body 128 of the bolt 110 has an integral firing pin 129 formed therein in axial alignment with the barrel 60. Accordingly the firing pin is adapted for reciprocating movement between a retracted position illustrated in FIGS. 2 and 5 (solid lines) and a forward firing position wherein the firing pin strikes the end of a cartridge and detonates the primer to fire the round.

Figure 6:
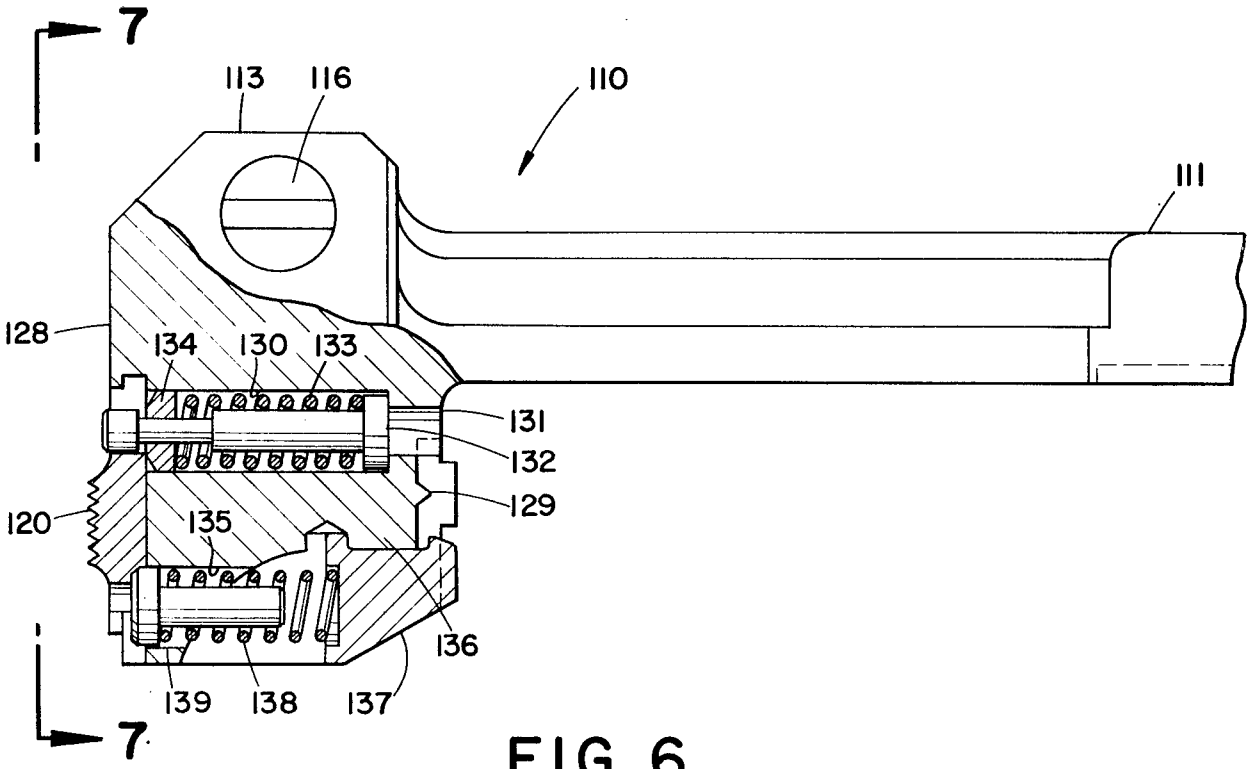
FIG. 6 is a fragmentary elevational view of the bolt block with parts broken away and shown in section for the purpose of illustration.
Figure 7:
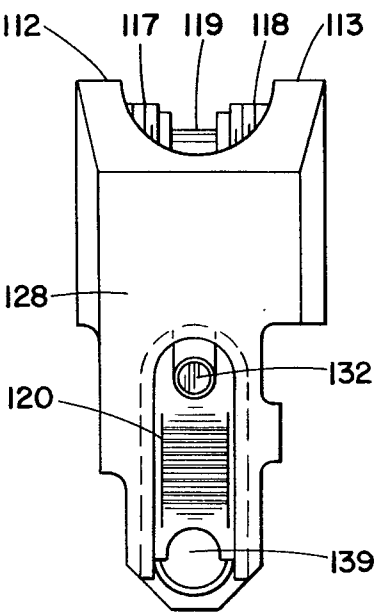
FIG. 7 is a rear end elevation of the bolt block taken from the line 7—7 of FIG. 6.

The main body 128 also has an ejector bore 130 formed therein that receives an ejector pin 131 with a shoulder 132 formed thereon to be engaged by a helical ejector spring 133 (FIGS. 6 and 7). The opposite end of the spring 133 bears against a washer 134. The pin 131 engages the bottom face of a cartridge and cooperates with an extractor to eject a spent cartridge in a conventional manner.

Another axially extending bore 135 together with a slot 136 receives an extractor 137 adapted to engage the rim of a cartridge and to extract the spent cartridge from the firing chamber. The extractor 137 rocks in its seat and is urged to a stable position by an extractor spring 138. The spring is retained by a spring guide 139 that urges the extractor in a forward direction. The guide 139 and ejector pin 131 are retained in position by a keeper 120 that is slidably received in a slot at the rearwardly facing end of the main body 128.

The front end of the forwardly extending leg 111 has two parallel notches 127 formed therein (FIG. 4) that are used to connect the muzzle sleeve 140 to the bolt 110. The muzzle sleeve 140 is of generally tubular cylindrical form defining a central bore 141 coaxial with the barrel 60. A counterbore 142 is formed in the rearward end of the muzzle sleeve 140 and is adapted to define a rearwardly facing shoulder. The helical recoil spring 65 is received in the space between the barrel 60 and the counterbore 142 and bears between the counterbore shoulder and the forwardly facing shoulder 64 on the barrel 60 to urge the bolt assembly 100 forwardly to the firing position illustrated in dashed lines in FIG. 5 and solid lines in FIG. 4.

The upper portion of the muzzle sleeve 140 has a pair of ribs 145 formed therein that fit into the notches 127 in the bolt to connect the muzzle sleeve 140 to the bolt 110.

Formed at the forward end of the muzzle sleeve 140 is a front piece 146 with a central opening 147 through which a round is propelled. The front piece also has an upwardly extending portion 148 with an opening 149 formed therein. The forward end of the pin 123 fits into the opening 149 to cooperate in locking the bolt and muzzle sleeve together. Disassembly is accomplished by depressing the pin 123 against the helical spring 126 to release the forward end of the pin 123 from the opening 149 and permit the muzzle sleeve to be rotated 90° to disengage the ribs 145 from the notches 127. The muzzle sleeve 140 can then slide forwardly away from the barrel 60 and bolt 110.

In accordance with the invention one or more annular internal grooves 150 are formed in the muzzle sleeve as best shown in FIGS. 4 and 5. The grooves are generally identical and have sloping rearward side walls 151 and flat annular front walls 152 which lie in radial planes relative to the axis of the muzzle sleeve 140. Other groove configurations may of course be used such as, for example, a helical groove.

After a round is fired the momentum of the gases escaping from the front end of the barrel 60 exerts forces against the rearwardly facing surface portions 152 to retard blowback of the slide assembly 100 in accordance with the invention.

It will be noted that after firing takes place the bolt is in its forwardly extending position illustrated in sold lines in FIG. 4 and in dashed lines in FIG. 5 so that all of the annular grooves are forward of the front end or discharge end of the barrel 60.

It should be noted that the muzzle sleeve 140 also serves to reduce both flash and noise.

Operation

In a typical operation of the weapon, such as when firing from a standing position, the operator holds the pistol with a magazine 11 inserted through the right hand stock 12 in a position with the stocks 12 and 13 extending laterally on opposite sides, with the user's wrist axes perpendicular to one another and with the top of the bolt 110 facing upwardly. The user then sights along the front and rear sights 124 and 116 at the top of the bolt and squeezes the trigger. This releases the sear 45 from the sear notch 160 in muzzle sleeve 140 and the helical bolt spring 65 forces the entire slide assembly 100 sharply forward to carry a cartridge **11*a* positioned in the breech by the magazine, forwardly into the firing chamber 62 and ultimately to bring the firing pin 129 into engagement with the rearward end of the cartridge that has been moved into the firing chamber. This fires the round which is propelled by the expanding gases through the barrel 60 and out through the opening 147 in the forward end of the muzzle sleeve 140**.

As this occurs two events begin simultaneously. The recoil force produced by the expanding gases urges the spent cartridge in a rearward direction to apply force urging the slide assembly 100 to its retracted position. Simultaneously the momentum of the gases escaping from the forward end of the barrel 60 exerts a force against the rearwardly facing surfaces 152 of the grooves 150 to partially counteract the force which drives the slide assembly rearward. The result is a retardation of the retraction of the slide assembly 100 to the rearward position preparatory to firing the next round.

After firing, a residual pressure exists in the chamber 62. This pressure forces the spent cartridge case to travel rearward with the bolt assembly 100. Once the cartridge is clear of the chamber, the ejector forces the base of the cartridge to move away from the bolt face. Since the extractor is holding the rim of the cartridge at its lowest point, the cartridge case is forced to rotate in a nose-downward manner. After about 20 degrees of rotation, the extractor releases the cartridge leaving it in free flight spinning in a down and rearwardly direction.

Assuming the trigger 41 is still depressed, the slide assembly 100, its recoil momentum spent, is now urged forward by the recoil spring 65 to feed the new cartridge into the firing chamber, bring the firing pin 129 into impact with the primer and fire the round at a cyclic rate that is reduced by the blowback retardation resulting from the modifying effect of the forces acting against the faces of the annular grooves 150.

It will be noted that the effects produced by this construction enable the bolt assembly 100 to be of relatively lightweight construction since a high inertia is not required to produce a satisfactory and advantageous control of the cyclic firing rate. The cyclic firing rate is, on the contrary, controlled by the modifying effect of the momentum of the gases escaping from the forward end of the barrel 60.

Likewise the retarding effect of the gas acting in conjunction with the muzzle sleeve 100, reduces the possibility of a premature opening of the chamber and possible rupture of the cartridge case, particularly when using a light-weight bolt.

While the invention has been shown and described with reference to a specific embodiment thereof, this is intended for the purpose of illustration rather than limitation and other variations and modifications of the specific design herein shown and described will be apparent to those skilled in the art all within the intended spirit and scope of the invention. Accordingly the patent is not to be limited in scope and effect to the specific embodiment herein shown and described nor in any other way that is inconsistent with the extent to which the progress in art has been advanced by the invention.

What is claimed is:

1. In a machine pistol having a receiver defining an open breech, means associated with said receiver for gripping the pistol for firing, a barrel having a rearward end fixedly connected to said receiver and defining a firing chamber that extends into said receiver, means for feeding ammunition rounds seriatim to said breech, a blowback-operable slide assembly adapted for reciprocating movement relative to said receiver and barrel between a forward firing position and a rearward retracted position for transfering an ammunition round from said breech to said firing chamber and for ejecting a spent ammunition cartridge from said breech, resilient means urging said slide assembly to said forward firing position, releasable means for retaining said slide assembly in said rearward retracted position and trigger means for releasing said retaining means, the improvement wherein said slide assembly comprises:

a bolt block slidable in said breech and having a firing pin carried thereby in axial alignment with said barrel; and a tubular cylindrical muzzle sleeve operatively connected to said bolt block and coaxially located on said barrel for axial movement thereon between a rearward position and a forward position projecting forwardly from the forward end of said barrel and free of locking relationship with said barrel, said muzzle sleeve having a forward end portion with internal means defining at least one rearwardly facing surface, said forward end portion and said rearwardly facing surface being located forwardly of said barrel when said muzzle sleeve is in its forward firing position and a part thereof including said rearwardly facing surface being located forwardly of said barrel when said muzzle sleeve is in its retracted position whereby the momentum of the gases escaping from the forward end of said barrel following firing exerts a force against said rearwardly facing surface to retard rearward movement of said slide assembly.

2. A machine pistol as defined in claim 1 wherein said internal means comprises at least one internal annular groove formed in said muzzle sleeve and having a rearwardly facing annular sidewall generally in a radial plane.

3. A machine pistol as defined in claim 2 wherein said internal means comprises a plurality of said annular grooves.

4. A machine pistol as defined either of claims 2 or 3 wherein said annular groove has a rearward wall that defines a sloping, outwardly-facing, frusto-conical surface.

5. A machine pistol as defined in either of claims 2 or 3 wherein said internal means comprises 5 of said annular grooves.

6. In a machine pistol having a receiver defining an open breech, means associated with said receiver for gripping the pistol for firing, a barrel having a rearward end connected to said receiver and defining a firing chamber that extends into said receiver and means for feeding ammunition rounds seriatim to said breech, the improvement which comprises:

a blowback-operable slide assembly adapted for reciprocating movement relative to said receiver and barrel between a forward firing position and a rearward retracted position for transferring an ammunition round from said breech to said firing chamber and for ejecting a spent ammunition cartridge from said breech, said slide assembly including a bolt with a leg portion extending forwardly therefrom, a tubular cylindrical muzzle sleeve located coaxially on said barrel for sliding movement thereon, said leg portion of said bolt being coextensive with and adjacent said muzzle sleeve and disengageable coupling means connecting said bolt and muzzle sleeve to one another, said coupling means including first interlocking means formed on said leg portion and second interlocking means formed on the exterior surface of said muzzle sleeve whereby said muzzle sleeve may be rotated on said barrel relative to said leg portion between a released position and a locking position wherein said first and second interlocking means are engaged to prevent axial movement of said muzzle sleeve relative to said leg portion, said bolt having a main body located in said breech with a firing pin carried thereby in axial alignment with said barrel, said muzzle sleeve projecting forwardly of the front end of said barrel when said slide assembly is in its forward firing position.

7. A machine pistol as defined in claim 6 wherein said receiver has an outwardly extending post formed thereon and defining a keyway means and wherein said leg portion of said bolt has longitudinally extending key means formed thereon adapted to be slidably received in said keyway means whereby said slide assembly is guided for said reciprocating movement by said keyway means and by said barrel on which said muzzle sleeve is slidably mounted.

8. A machine pistol as defined in claim 6 wherein said muzzle sleeve has internal means defining at least one rearwardly facing surface located forwardly of said barrel when said muzzle sleeve is in its forward firing position whereby the momentum of the gases escaping from the forward end of said barrel following firing exerts a force against said rearwardly facing surface to retard rearward movement of said slide assembly.

9. A machine pistol as defined in claim 6 wherein said first interlocking means comprises at least one lateral groove formed in said leg portion in the surface thereof facing said muzzle sleeve and wherein said second interlocking means comprises at least one radially extending rib portion adapted to fit in said groove when said muzzle sleeve is rotated to its locking position.

10. A machine pistol as defined in claim 9 wherein said coupling means further includes a radial projection on the forward end of said muzzle sleeve that defines an opening and a latch pin mounted at the forward end of said leg portion parallel to said barrel for axial movement between a retracted position and a forwardly extending position and resilient means urging said latch pin to said forwardly extending position whereby when said muzzle sleeve is rotated to its locking position, said latch pin is adapted to extend into said opening to retain said muzzle sleeve in said locking position against radial movement relative to said leg portion.

11. An automatic pistol having a receiver, said receiver having means for gripping the pistol for firing, a post extending outwardly from said receiver, a barrel having a rearward end connected to said post and defining a firing chamber that opens on one side of said post, said barrel extending forwardly on the other side of said post, means for feeding ammunition rounds seriatim to said firing chamber, a blowback-operable slide assembly adapted for reciprocating movement relative to said receiver and barrel between a forward firing position and a rearward retracted position for transferring an ammunition round to said firing chamber and for ejecting a spent cartridge case from said firing chamber, guide means on said post slidably receiving said slide assembly, said slide assembly including a tubular cylindrical muzzle sleeve located coaxially on said barrel for sliding movement thereon, said muzzle sleeve projecting forwardly of the front end of said barrel when said slide assembly is in its forward firing position, said slide assembly including a bolt having a main body located on said one side of said post with a firing pin carried thereby in axial alignment with said barrel, recoil spring means biasing said slide assembly to the forward position.

12. In a machine pistol having a receiver defining an open breech, means associated with said receiver for gripping the pistol for firing, a barrel having a rearward end connected to said receiver and defining a firing chamber that extends into said receiver, means for feeding ammunition rounds seriatim to said breech, a blowback-operable slide assembly adapted for reciprocating movement relative to said receiver and barrel between a forward firing position and a rearward retracted position for transfering an ammunition round from said breech to said firing chamber and for ejecting a spent ammunition cartridge from said breech, resilient means urging said slide assembly to said forward firing position, releasable means for retaining said slide assembly in said rearward retracted position and trigger means for releasing said retaining means, the improvement wherein said slide assembly comprises:

a bolt block slidable in said breech and having a main body with a firing pin carried thereby in axial alignment with said barrel, and a forwardly extending arm; and a tubular cylindrical muzzle sleeve operatively connected to said bolt block and coaxially located on said barrel for axial movement thereon between a rearward position and a forward position projecting forwardly from the forward end of said barrel, said muzzle sleeve being connected to said forwardly extending arm by means including at least one rib extending radially from the outer surface of said muzzle sleeve, and cooperating groove means on said arm whereby said muzzle sleeve may be rotated relative to said arm to bring said rib and groove into locking engagement, and means operatively associated with said arm and said muzzle sleeve at the forward ends thereof for locking said barrel against rotation relative to said arm, said muzzle sleeve having a forward end portion with internal means defining at least one rearwardly facing surface, said forward end portion and said rearwardly facing surface being located forwardly of said barrel when said muzzle sleeve is in its forward firing position and a part thereof including said rearwardly facing surface being located forwardly of said barrel when said muzzle sleeve is in its retracted position whereby the momentum of the gases escaping from the forward end of said barrel following firing exerts a force against said rearwardly facing surface to retard rearward movement of said slide assembly.

* * * * *